United States Patent [19]

Choi

[11] Patent Number: 4,802,435

[45] Date of Patent: Feb. 7, 1989

[54] SAFETY BOAT ASSEMBLY

[75] Inventor: Tai J. Choi, 1375 Hwanghak-Dong, Joong-Ku, Seoul, Rep. of Korea

[73] Assignees: Tai Jin Choi; Jung Bai Kim; Young Sung Park; Sai Hwan Kim, all of Seoul, Rep. of Korea

[21] Appl. No.: 138,951

[22] Filed: Dec. 29, 1987

[30] Foreign Application Priority Data

Jan. 9, 1987 [KR] Rep. of Korea ..... 139/1987

[51] Int. Cl.[4] ..... B63B 43/12

[52] U.S. Cl. ..... 114/360; 114/69

[58] Field of Search ..... 114/348, 349, 360, 66, 114/68, 69; 441/16

[56] References Cited

U.S. PATENT DOCUMENTS

| | | | |
|---|---|---|---|
| 804,797 | 11/1905 | Deydier | 114/360 |
| 1,750,773 | 3/1930 | Burmester et al. | 114/348 |
| 1,784,819 | 12/1930 | Cochard | 114/349 |
| 2,724,132 | 11/1955 | Shoup et al. | 114/360 |
| 4,669,990 | 6/1987 | McDermott | 441/16 |

*Primary Examiner*—Sherman D. Basinger

*Attorney, Agent, or Firm*—Birch, Stewart, Kolasch & Birch

[57] ABSTRACT

A safety boat assembly which includes air bags, a breathing device, a tubular pole containing a dense material, safety belts, a gravity on/off light switch, and a view finding window disposed therein for improving buoyancy and stability and for reducing the dangers associated with boating accidents when the boat assembly is turned over.

11 Claims, 5 Drawing Sheets

SAFETY BOAT ASSEMBLY

BACKGROUND OF THE INVENTION

1. Field of the Invention

The present invention relates to a safety boat assembly and more specifically to a safety boat assembly which contains air bags operatively associated with a body member and auxiliary body members for improving a floating force and mercury disposed in a tubular pole for improving the gravity force thereof. The safety boat assembly also includes automatic fresh air supply systems and an automatic lighting system, for use when the boat assembly is capsized by accident, so as to facilitate the rescue of the passengers therein the various dangers.

2. Description of the Prior Art

Safety boats are well known in the art which include air gabs. However, there are many problems, for example, when the boat is tilted over, there is no fresh air supply and there is no source of light. Furthermore, such boats perform poorly in the heavy seas since these boats are usually light weight.

SUMMARY OF THE INVENTION

Accordingly, it is an object of the present invention to provide an improved safety boat assembly for protecting the passengers against various dangers when the boat is capsized.

Another object of the present invention is to provide a safety boat assembly which includes a plurality of air bags disposed therein for increasing the buoyancy and sailing performance thereof.

A further object of the present invention is to provide a safety boat assembly which is structured with a breathing device disposed within cabins thereof for automatically introducing the fresh air into the cabins thereof when the boat is turned over.

Still another object of the present invention is to provide a safety boat assembly which includes a tubular pole which stands erect on the boat assembly and which is filled with a dense material in the lower portion of the pole so that the weight of the dense material adds its weight to the weight of the boat assembly for preventing the boat assembly from being turned over because of strong wind and waves. Also, the pole is extendable out of the bottom surface of the boat assembly so as to enable one to esily return the capsized boat assembly to its upright position by grasping and lifting the end portion of the extended pole with little effort.

Yet another object of the present invention is to provide a boat assembly which includes safety belts for passengers so as to prevent their separation from the capsized boat assembly in the water and waves.

A further object of the present invention is to provide a boat assembly which includes several pieces of equipment, such as for example rubber handles fixed in the interior of the boat wall for being grasped by the passengers, a light automatically operated by a gravity on/off switch and a view window for observing the outside scene when the boat assembly is turned over.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a safety boat assembly which includes air bags, a breathing device, a tubular pole containing a dense material, safety belts, a light having a gravity on/off switch, and a view window disposed therein for improving the floating stability and the gravity distribution of the boat assembly and for reducing various dangers when the boat assembly is turned over.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
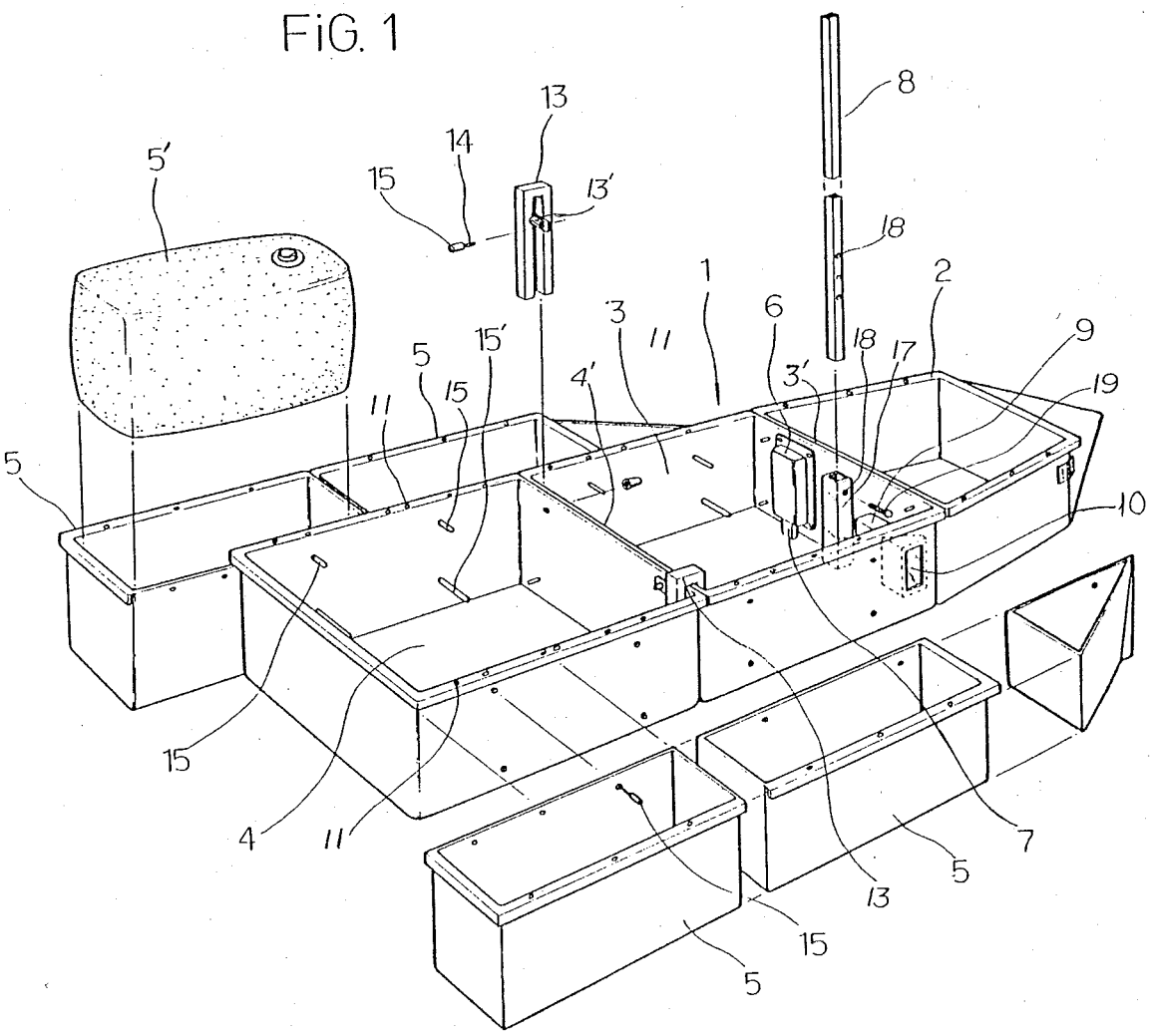
FIG. 1 is an exploded view of a boat assembly according to the present invention.
Figure 2:
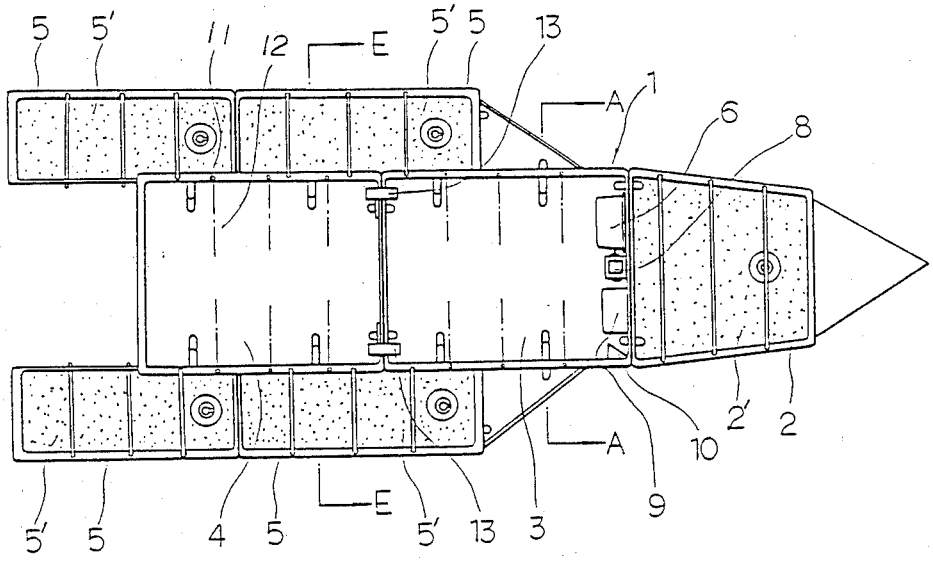
FIG. 2 is a top plan view of the boat assembly according to the present invention.
Figure 3:
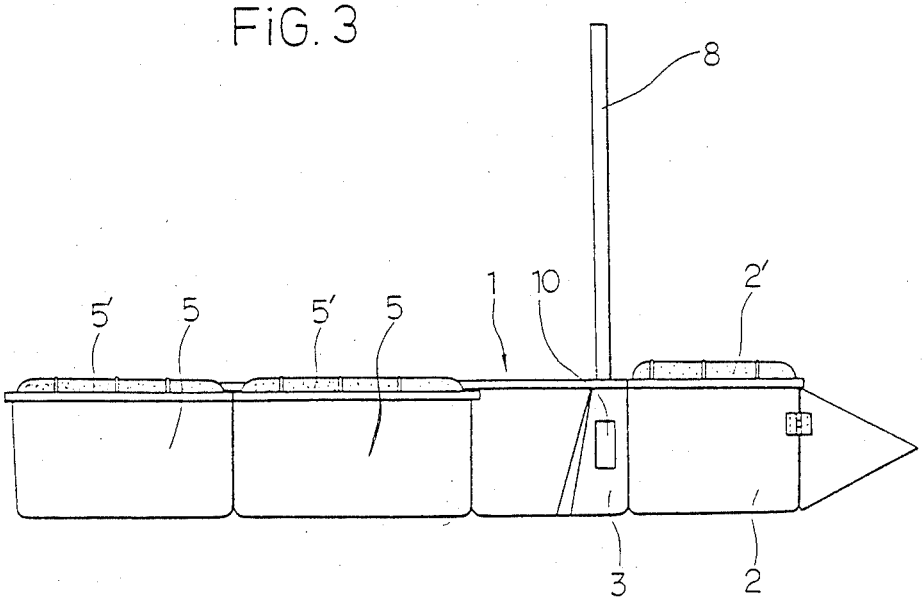
FIG. 3 is a side elevational view of the boat assembly according to the present invention.
Figure 4:
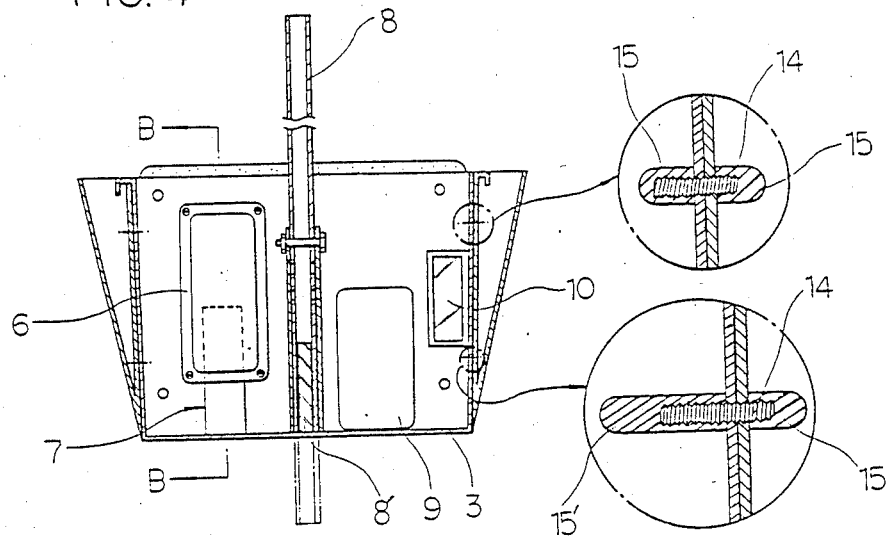
FIG. 4 is a cross-sectional view of FIG. 2, taken along line A—A.
Figure 5:
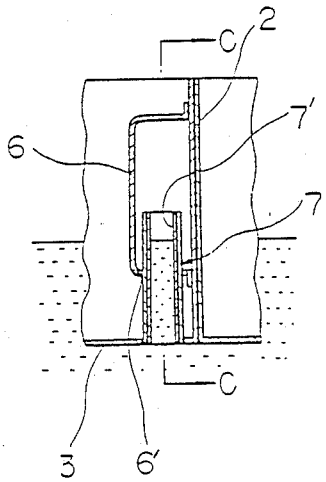
FIG. 5 is a cross-sectional view of FIG. 4, taken along line B-B.
Figure 6:
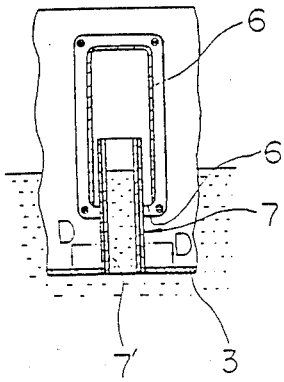
FIG. 6 is a cross-sectional view of FIG. 5, taken along line C—C.
Figure 8:
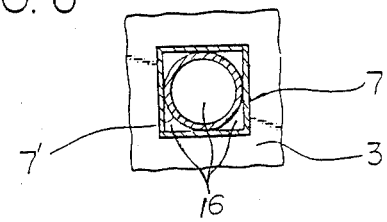
FIG. 8 is a cross-sectional view of FIG. 6, taken along line D—D.

Referring now in detail to the drawings for the purpose of illustrating a preferred embodiment of the present invention, the safety boat assembly as shown in FIGS. 1, 2 and 3 includes a body member 1 which contains a front cabin 3 and a rear cabin 4 disposed in the middle and rear portions thereof, respectively, and a front chamber 2 disposed in the front portion thereof for containing an air bag 2' disposed therein. The body member 1 is provided with a plurality of side chambers 5 attached to both sides thereof for containing a plurality of air bags 5' disposed therein. The front cabin 3 is provided with an air passing cylinder attached to the interior of a front wall 3' for containing a rectangular, tubular air inlet member 7 at an opening 6' disposed at the air passing cylinder 6. The air inlet member 7 extends to the bottom surface of the front cabin 3 and contains a circular tube 7' disposed therein for readily introducing the air through apertures 16, as shown in FIG. 8, when the boat assembly is capsized. A tubular supporting member 17 attached to the interior of the front wall 3' of the front cabin 3 is adapted to receive a tubular pole 8. The tubular supporting member 17 and tubular pole 8 have a rectangular configuration for tightly engaging the pole 8 within the supporting member 17. The tubular pole 8 contains a dense material 8' disposed in lower portion thereof for increasing the pole's weight and that of the boat assembly so as to stabilize the boat assembly in heavy waves. The tubular pole 8 is made of a solid material such as metal, hard plastic, or the like. Also, the tubular pole 8 has a plurality of apertures 18 for adjusting the pole 8 to the supporting member 17 by aligning a bolt 19 through an aperture 18 disposed in the supporting member 17. If necessary, the pole 8 can be moved to jut out of the bottom surface of the boat assembly as shown in FIG. 4 so as to allow one to easily grasp it and return the capsized boat assembly 1 to its upright position.

Figure 13:
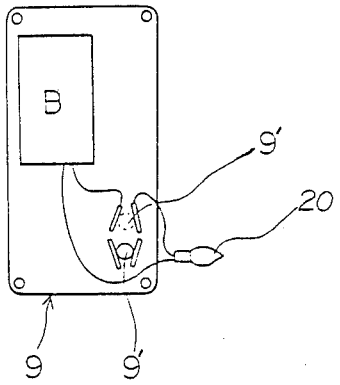
FIG. 13 diagrammatically shows a lighting system having an on/off gravity switch according to the present invention.

A light device 9-, as shown in FIGS. 1 and 2, is attached to the interior of the wall 3' of the front cabin 3. The light device 9 contains a battery B, a on/off gravity switch 9', and a light bulb 20. The light bulb 2 .is automatically lighted by the gravity switch when the boat assembly is turned over (FIG. 13). The light device 9 is provided near a view finding window 10 for allowing one to observe the outside scene with the lightened bulb 20 when the boat assembly 1 is capsized.

Figure 9:
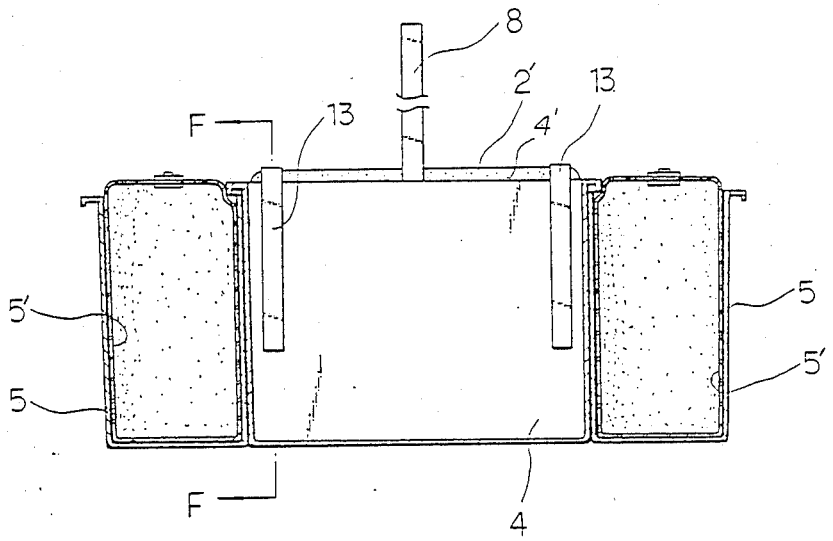
FIG. 9 is a cross-sectional view of FIG. 2, taken along line E—E.
Figure 10:
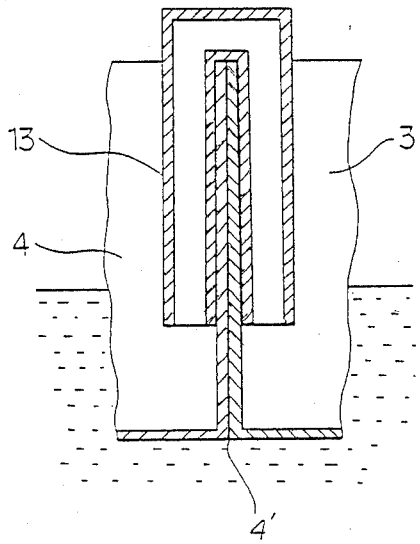
FIG. 10 is a cross-sectional view of FIG. 9, taken along line F—F.
Figure 11:
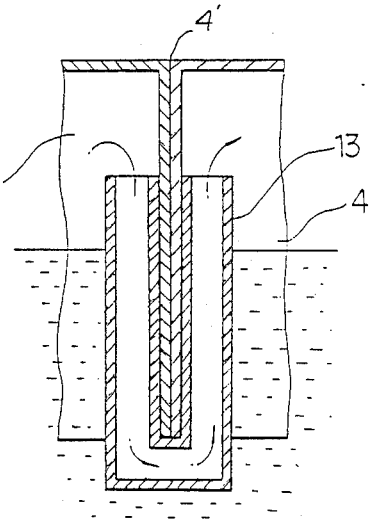
FIG. 11 is a cross-sectional view of FIG. 9, taken along line F—F in the capsized boat position.

A wall 4' disposed between the front cabin 3 and the rear cabin 4 is provided with a rectangular U-shaped pipe 13 having an engagement member 13'. The U-shaped pipe 13 is arranged on both sides of the wall 4' for introducing fresh air from the front cabin 3 to the rear cabin 4 when the boat assembly is capsized as shown in FIGS. 9, 10, and 11. The U-shaped pipe 13 is mounted to the wall 4 by a screw 14 having a short rubber cover 15 through the engaging member 13' thereof (FIG. 1). Air bag side chambers 5 are attached to the body member 1 by the screws 14 having the short rubber cover 15 disposed at both ends thereof. Also, the screws 14 disposed in the lower portion of the side wall in the cabins 3 and 4 have a long rubber cover 15' for use by passengers as a grasping handle (FIGS. 1 and 4).

Figure 12:
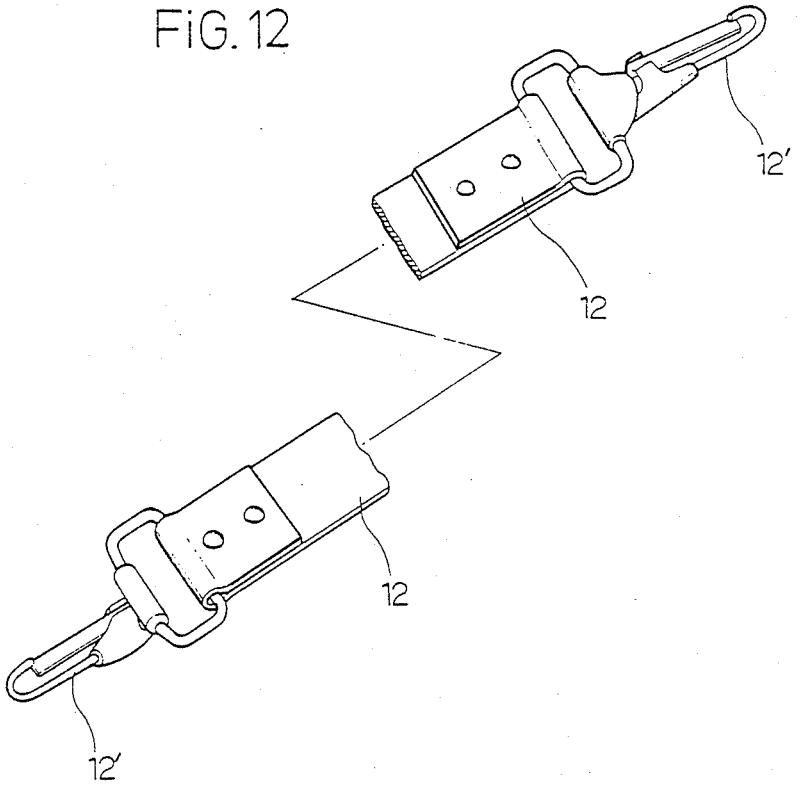
FIG. 12 shows a perspective view of a safety belt according to the present invention.

A plurality of apertures 11 disposed in the side wall of the cabins 3 and 4 are adapted to receive hooks 12' of a safety belt 12 for securing the passengers to the cabins 3 and 4 (FIG. 12).

Figure 7:
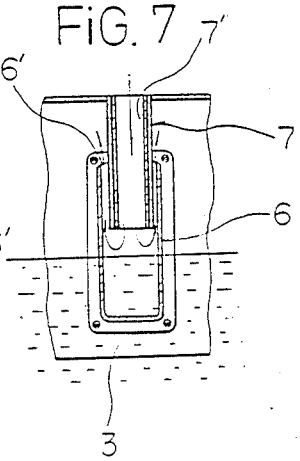
FIG. 7 is a cross-sectional view of FIG. 5, taken along line C—C in a capsized boat position.

In operation, when the boat assembly is turned over during sailing, the passenger is prevented frm being separated from the boat assembly since the passenger is secured to the safety belt I2 which is attached to the interior walls of the cabins 3 and 4, and the passenger is able to grasp the handle 15'. At this time, as shown in FIG. 7, the fresh air in the atmosphere is introduced into the front cabin 3 through the plurality of apertures 16 disposed in the tubular air inlet member 7 and the opening 6' of the air passing cylinder 6. And the fresh air is introduced from the front cabin 3 to the rear cabin 4 through the U-shaped pipe 13 for supplying the fresh air to the victim (FIG. 11). At this time, simultaneously, the light bulb 20 is lighted by the on/off gravity switch and the victim can observe the outside scene through the view finding window 10 (FIG. 13). Also, the capsized boat assembly can be easily returned to its upright position by using the end portion of the pole 8 which extends out of the bottom surface thereof with little effort being required by the rescuer.

Further according to the present invention, the probability of being capsized by a strong wind or waves is greatly reduced because of the gravity function of the dense material 8' disposed in the lower portion of the rectangular pole 8. This dense material may be mercury, for example.

Also, the safety boat assembly of the present invention contains the plurality of air bags 2' and 5' disposed within the cabins 3 and 4, and air bag side chambers 5 for improving the floating force thereof.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A safety boat assembly having air bags which comprises:

a body member which includes a front cabin and a rear cabin disposed in the middle and rear portion of said body member, respectively, and a front chamber, disposed in the front portion of said body member, a plurality of side chambers, attached to both sides of said body member, wherein said front chamber and said side chambers contain air bags disposed therein for improving the floating stability of the boat assembly, a tubular pole, disposed in said front cabin and supported by a supporting member which is mounted to an interior wall between said front cabin and said front chamber, said tubular pole containing a dense material in the lower portion thereof for increasing the weight of the boat assembly so as to stabilize the boat assembly in heavy waves, an air passing cylinder attached to said interior wall, wherein said air passing cylinder receives a tubular air inlet member for introducing fresh outside air from the atmosphere into the front cabin when the boat assembly is capsized, and a light device attached to said interior wall for automatically lighting a light bulb by means of a gravity on/off switch which operates when the boat assembly is turned over, whereby the boat assembly reduces dangers associated with boating accidents and exhibits improved buoyancy and sailing stability.

2. The safety boat assembly of claim 1, wherein the side chambers are attached to the body member by means of a screw, wherein said screw includes a rubber cover.

3. The safety boat assembly of claim 2, wherein the rubber cover covering the screw extends into a cabin to form a passenger handle.

4. The safety boat assembly of claim 1, wherein the tubular pole and the supporting member have a rectangular configuration so that said tubular pole tightly fits into said supporting member.

5. The safety boat assembly of claim 1, wherein the tubular pole contains a plurality of apertures disposed therein so as to receive a bolt for adjusting the pole position in the supporting member.

6. The safety boat assembly of claim 5, wherein the tubular pole extends to jut out of the bottom surface of the boat assembly so as to form a capsize handle for easily returning the capsized boat assembly to its upright position by using said handle to the boat assembly and wherein the dense material is mercury.

7. The safety boat assembly of claim 1, wherein the tubular pole is made of metal.

8. The safety boat assembly of claim 1, wherein the tubular pole is made of hard plastic.

9. The safety boat assembly of claim 1, wherein the tubular air inlet member includes a circular tube disposed therewith and a plurality of apertures to pass the air when the boat assembly is turned over.

10. The safety boat assembly of claim 1, wherein a wall disposed between the oabins is provided with a U-shaped air pipe disposed over both sides thereof for introduoing the fresh air from the front cabin to the rear cabin when the boat assembly is capsized.

11. The safety boat assembly of claim 1, wherein the internal wall disposed between the front chamber and the front cabin is provided with a view finding window attached thereto for observing the outside scene.

* * * * *